United States Patent [19]

Pavilon

[11] 4,172,857

[45] Oct. 30, 1979

[54] PROCESS AND APPARATUS FOR ETHYLENE PRODUCTION

[75] Inventor: Stanley J. Pavilon, Shaker Heights, Ohio

[73] Assignee: Arthur G. McKee & Company, Independence, Ohio

[21] Appl. No.: 893,241

[22] Filed: Apr. 3, 1978

[51] Int. Cl.[2] ..... C07C 3/30

[52] U.S. Cl. ..... 585/635; 585/652; 208/127; 422/145

[58] Field of Search ..... 260/683 R; 208/127

[56] References Cited

U.S. PATENT DOCUMENTS

| | | | |
|---|---|---|---|
| 3,171,369 | 3/1965 | Stephens et al. | 48/206 |
| 3,221,076 | 11/1965 | Frey et al. | 260/683 R |
| 3,661,543 | 5/1972 | Sexton | 208/127 |
| 3,848,016 | 11/1974 | Kono et al. | 208/127 |
| 4,057,490 | 11/1977 | Wynne | 260/683 |
| 4,080,285 | 3/1978 | McKinney et al. | 260/683 R |

*Primary Examiner*—C. Davis

*Attorney, Agent, or Firm*—Pearne, Gordon, Sessions, McCoy & Granger

[57] ABSTRACT

A thermal cracking process and apparatus are disclosed for economical manufacture of lower olefins and valuable coproducts by pyrolysis of liquid or gaseous hydrocarbon feedstocks ranging from ethane to tar sands, particularly feedstocks, such as gas oil, naphtha, residual oils or tar sands. The pyrolysis unit is a riser reactor heated by hot agglomerated ash particles and designed for short residence time to minimize the time of contact of the feedstock with the hot ash. The agglomerated ash is continually produced in a fluidized bed combustion unit by burning particles of coal or other solid carbonaceous material, and the hot agglomerated ash is continually forced upwardly through the riser by superheated steam which is further superheated in the riser reactor and which serves as dilution steam for hydrocarbon partial pressure reduction. Additional dilution steam enters the reactor with the preheated feedstock. A water quench at the outlet of the reactor slows down or stops secondary reactions as the cracked gases are separated from the hot ash in a roughing cyclone separator. The ash particles, which are coated with coke or char after reaction, are preferably steam stripped to remove occluded hydrocarbon and are thereafter recycled to the bed of the combustion unit. If the feedstock is tar sand or a feedstock with high coking tendencies, it may be preferable to burn at least part of the char or coke coated ash and/or sand particles from the riser reactor in a separate burner and thus dispose of some of the solids before the ash recycle to the main combustion unit.

21 Claims, 1 Drawing Figure

PROCESS AND APPARATUS FOR ETHYLENE PRODUCTION

BACKGROUND OF THE INVENTION

The present invention relates to a process and apparatus for thermal cracking of liquid or gaseous hydrocarbons, ranging from ethane to gas oil, crude oil, residual oils or tar sands and more particularly to a non-catalytic cracking process employing a pressurized riser-type thermal cracker heated by hot agglomerated ash particles circulated from a separate coal burning power producing combustion unit.

The core of the petroleum chemical industry is represented by the production of the lower olefins. In this country ethane cracking has heretofore been considered the most practical way to produce ethylene, and the ethane can readily be extracted from "wet" natural gas available here.

In European countries which do not have a ready supply of such "wet" natural gas, the ethane is more costly and chemicals such as ethylene, propylene and valuable coproducts have been produced by naptha cracking. This is a less economical way of producing ethylene than by ethane cracking. However, the values of the coproducts are becoming better appreciated in this country, and the desirability of naphtha cracking increases as the long term availability of ethane for cracking to ethylene becomes more questionable.

Because naphtha is not widely available in this country for steam cracking, heavier feedstocks, such as gas oil provide an attractive source, and there has long been a need for an efficient economical process for producing lower olefins from the heavier feedstocks. Various systems have been proposed, but they have had serious shortcomings and have not provided the most economical way to affect thermal cracking of the heavy feedstock.

One problem when using feedstocks such as gas oil, crude oil or residual oils, is that coke or char forms during pyrolysis and tends to foul up the equipment. In one proposed fluidized bed cracking process, such fouling is avoided because the coke particles formed in the bed are spatially separated from the cracking operation and burned in the lower part of the reactor. In a proposed "fluidized-flow" process which uses inert ceramic heat-carrier particles as the heat transfer media, the ceramic particles become coated with coke or char in the fluidized bed of the pyrolysis unit. These ceramic particles are continually removed from the bottom of the unit and the coke thereof is burned with additional fuel in a separate burner unit to reheat the particles while removing the coke or char therefrom.

In conventional plants for naphtha cracking, the pyrolysis unit is heated exterally using oil-fired or gas-fired furnaces for supplying heat. The various proposed alternative methods of supplying heat such as heated ceramic particles, sand or refractory checker work, high-temperature steam and flame cracking techniques do not appear to be commercially attractive at the present time.

During the last decade there have been unprecedented increases in the capital costs for chemical plants and further costs involved in reducing air pollution and meeting other environmental requirements. There has been an increasing need for the economies possible in chemical plants of large size. When such factors are taken into consideration, few processes are sufficiently efficient and economical to meet the requirements for a commercially attractive chemical plant.

The process of the present invention can meet those requirements because of its high efficiency and also because it uses a readily available feedstock, such as gas oil, residual oils, tar sands or diatomaceous earth containing oil. In the past, residual oils such as reduced crude or vacuum residuum could not be processed by a petroleum refiner in a fluid bed catalytic cracker because of the high Conradson carbon of the oil and mainly because of the unusually high metals content of these feedstocks which tend to poison the catalyst. The process of this invention could replace the cat cracker and thus provide the refiner with an ethylene unit and a gasoline and fuel oils producer utilizing vacuum residuum as a feedstock. Because ash is produced in the process, the continuous purge of ash can effectively handle the metals problem whereas an expensive catalyst becomes poisoned by the metals. The metals can be recovered from the ash purged if desired.

The high Conradson carbon of these residual oils tends to upset the heat balance of the fluid cat cracker and some means must be provided to remove the added heat generated from burning of the high coke laydown on the catalyst. By the process of this invention, it is only necessary to reduce the coal feed to the burner to keep the unit in heat balance.

Although ethylene yield may be limited in such an operation because of the refractory type feedstock handled, the process is advantageous and will provide a means for producing other upgraded products such as gasoline and mid distillates which heretofore could not be economically produced from vacuum residuum except by an expensive coking process.

Heretofore, various methods have been proposed for recovering hydrocarbons from tar sands but the recovered hydrocarbons have been too expensive to compete with petroleum crudes recovered by more conventional methods, particularly because of the difficulty in processing large volumes of sand. Also the oil obtained from tar sands has been considered less valuable because it is heavier and more viscous than conventional petroleum crude. The present invention permits economical production of ethylene and valuable coproducts from tar sand and makes possible efficient processing, separation and disposal of the sand.

SUMMARY OF THE INVENTION

The present invention provides a simple, economical process for producing ethylene and valuable coproducts from available hydrocarbon feedstocks, such as gas oil, using hot agglomerated ash particles in the pyrolysis unit as the source of heat for the endothermic cracking reactions and using combustion gases from a separate pressurized ash-agglomerating coal combustion unit to recover power.

The process of the invention employs a riser reactor heated by hot agglomerated ash particles which are continually fed upwardly through the reactor by superheated steam and are then separated from the cracked gases preferably in a roughing cyclone separator and further in a number of two-stage cyclones. A preheated hydrocarbon feedstock, preferably gas oil or naphtha, is fed to the riser reactor, mixed with dilution steam, and maintained under a short residence time in the reactor, at a temperature of from 700° to 1000° C. The cracked gases are preferably quenched with water at the roughing cyclone separator to minimize unwanted secondary reactions.

The separated ash particles are collected and thereafter recycled to the combustion unit to burn off the char or coke formed on the ash particles and to reheat the ash. The ash particles from the cyclone separator are steam stripped in a separate fluidized-bed vessel to remove occluded hydrocarbon before the ash is recycled.

The char or coke on the ash particles from the cyclone separator may also be burned in a separate auxiliary burner unit before the ash is recycled. A portion of the air being supplied for combustion may, for example, be passed through such auxiliary unit to support the combustion therein. Part of the ash or other solid material may also be removed from such auxiliary burner unit. Such an auxiliary unit may be desirable when handling feedstocks which tend to cause formation of excessive amounts of coke or char or when handling tar sands or other feedstocks containing substantial amounts of solid particulate material.

In the process disclosed herein, the agglomerated ash particles are produced in the combustion unit by burning finely divided particles of coal or other carbonaceous material (preferably bituminous coal) which are introduced into the fluidized bed of ash particles. Air or other oxygenous gas is passed upwardly through the bed to fluidize the bed and burn the carbonaceous material. The temperature is controlled to cause the ash particles to stick together and agglomerate so that production of particulate matter is greatly reduced and the flue gases are relatively free of entrained ash particles.

The combustion unit is constructed to produce large volumes of ash-free combustion gases for power recovery and is operated at pressures, such as 2 to 8 atomospheres. The combustion gases are cooled in a heat exchanger or boiler and then passed through a gas turbine or expander to recover the power needed for driving the air compressor and for producing electricity.

The operation of the system under pressure with heat and power recovery as disclosed herein and with effective combustion of the coke or carbonaceous material on the ash particles makes it possible to achieve remarkable thermal efficiency with minimum waste of fuel and to produce ethylene and valuable coproducts in an economical manner. The fuel and energy requirements for a large plant are reduced substantially, particularly cracked gas compression costs required for downstream processing.

The system is economical and highly advantageous in that it uses readily available fuels, such as coal, and conserves valuable gas and oil. It can also use an inexpensive feedstock rather than ethane or light hydrocarbon oils. Because the system does not require methane as a fuel, as in prior art processes, the methane produced and recovered from the cracked gases may be sold as synthetic gas or diverted to production of petrochemicals, such as $NH_3$ or methanol.

The process of this invention is also advantageous to a petroleum refiner because it produces production variety of useful products, in addition to ethylene, and provides the refiner with great flexibility. The plant can crack heavy hydrocarbons and also light hydrocarbons. Ethane, for example, can be recycled to improve the yield of ethylene. The feedstocks can also be modified when desired. Some of the olefins, such as propylenes and butylenes can be alkylated or made into polymer gasoline. The $C_5$–$C_6$ cut can be isomerized. Gasoline and fuel oils are also produced. The unit could replace a catalytic cracker if olefin producton is desired.

A further advantage of the invention is that it can employ feedstocks which heretofore were hard to process because of high coking tendencies, high metals content, or high content of solid particulate material. The effective burning of coke deposits and disposal of solid material makes it possible to handle a wide variety of inexpensive feedstocks including tar sands and feedstocks containing substantial amounts of undesirable metals.

Other uses and advantages of the invention will become apparent from the drawings, description and claims which follow:

DESCRIPTION OF THE PREFERRED EMBODIMENT

Figure 1:
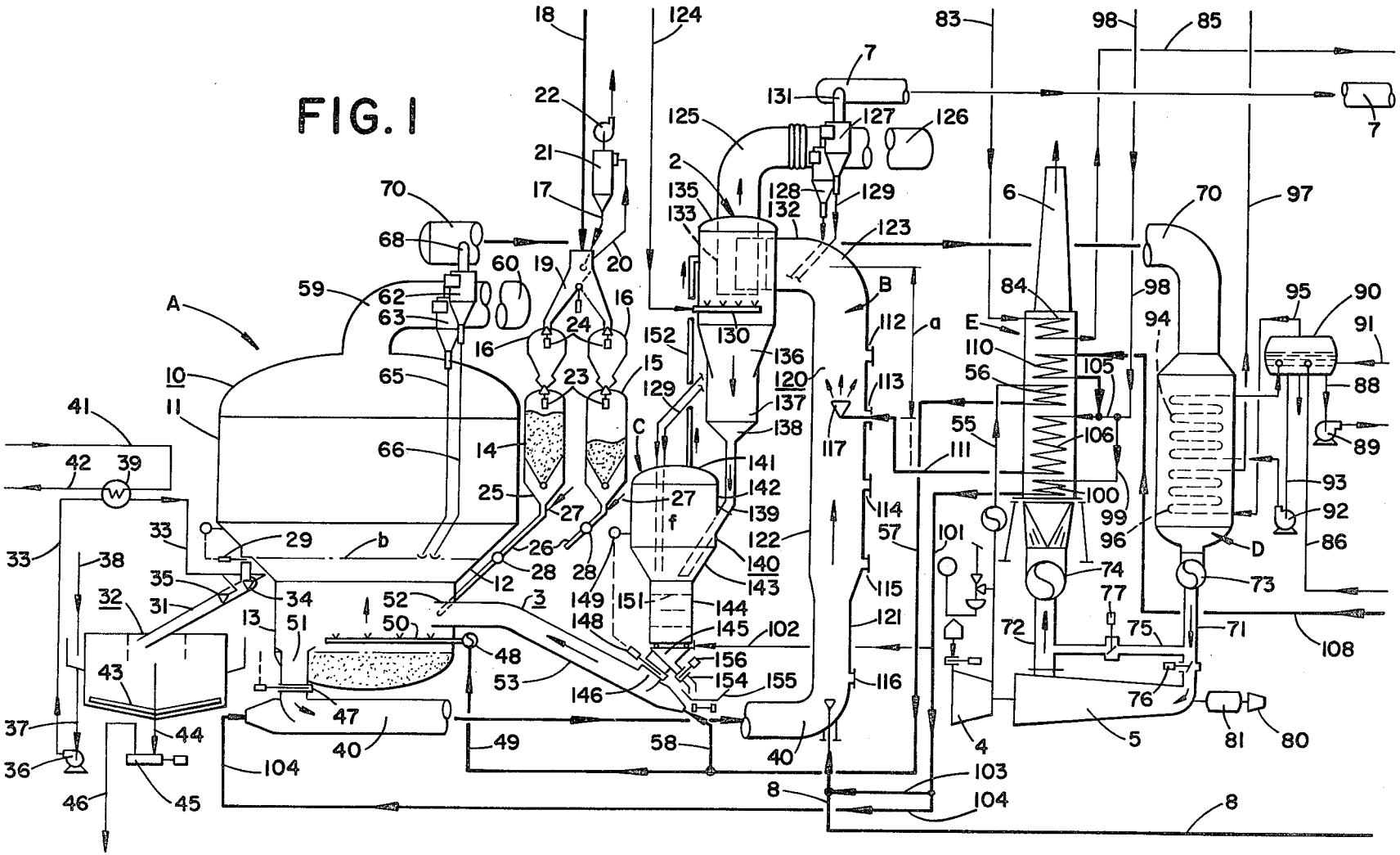

FIG. 1 is a fragmentary diagrammatic elevational view on a reduced scale showing a chemical plant constructed according to the present invention for production of ethylene, propylene and co-products by pyrolysis of liquid hydrocarbon feedstocks, such as gas oil.

Referring to the embodiment of FIG. 1, the plant shown has a large ash-agglomerating combustion unit A for burning coal or other carbonaceous material, a pyrolysis unit B for thermal cracking of hydrocarbon feedstocks, conduit means for transferring hot agglomerated ash from the combustion unit to the pyrolysis unit to provide the heat required for the endothermic cracking reactions, an ash stripper unit C containing a fluidized bed f of ash particles received from the cyclone separator 2 of the pyrolysis unit, and conduit means 3 for recycling the ash particles to the combustion unit. The units A and B are pressurized by compressed air from a compressor 4 driven by a gas expander or turbine 5. The flue gases from the combustion unit A are cooled in a boiler or steam generator D before passing through the gas turbine 5 and are further cooled in a heat exchanger E before discharged through the stack 6 to atmosphere.

The cracked hydrocarbon gases from the pyrolysis unit pass through a duct 7 to a conventional heat exchanger (not shown) where they are cooled before entering a fractionation tower (not shown) or other conventional fractionation equipment. Various quench and fractionation systems may be employed to cool the cracked hydrocarbons and recover the various hydrocarbon fractions. In order to improve the yield of ethylene, it is sometimes preferable to collect the ethane or lower alkane gas and recycle it through conduit B to the pyrolysis unit.

The combustion unit A may be of various forms as will be apparent to those skilled in the art, and agglomeration of the ash particles can be accomplished within or outside of the fluidized bed. The unit is preferably operated in such a manner that the flue gases are relatively free of ash particles or so that removal of ash from the flue gases is not unduly expensive. Combustion gases relatively free of ash particles are needed for driving the gas turbine, and it is known that an ash-agglomerating coal burner is well suited for this purpose as disclosed in U.S. Pat. No. 3,171,369.

As herein shown, the combustion unit A comprises a large refractory-lined vessel 10 having a cylindrical upper wall portion 11, tapered intermediate wall portion 12, and a cylindrical lower wall portion 13 which is filled by a fluidized bed b of agglomerated ash particles. As shown, the normal level of the top surface of the bed is near the middle of the wall portion 12 about half way between the cylindrical portions 11 and 13. This level can be controlled automatically by removing excess ash continually or periodically.

Conventional equipment may be employed to feed solid pulverulent particles of coal, coke or other carbonaceous material to the combustion unit, and small amounts of dolomite, limestone or other materials may be included if desired for reducing nitrogen oxide or sulfur dioxide emissions and for eliminating the need for flue gas scrubbing equipment. Minor amounts of liquid hydrocarbons may also be included with the coal particles, particularly during the start up, but is preferable to minimize or avoid use of liquid fuel after the unit is at a normal operating temperature, such as 1000° to 1150° C.

Conventional means may b used to maintain the desired temperature for ash agglomeration, which will vary according to the type of fuel used and the ash fusion temperature. The temperature should be kept generally below 1200° C. and below the incipient ash fusion temperature to avoid excess fusion or excess agglomeration of the ash particles but should be high enough to form agglomerated ash particles of the desired size and to reduce the amount of fly ash in the flue gas. Usually the temperature in the unit A should be from about 1000° to about 1150° C. when using coal as the fuel, but somewhat lower temperatures, such as 900° C. may be adequate if flux is employed. In any event, the combustion unit A is operated under ash-agglomerating conditions to provide agglomerated ash particles of a size suitable for feeding to the pyrolysis unit B.

As herein shown, the unit A is designed for burning coal and has a pair of lock hoppers 14 and 15 with upper receptacles 16 which receive finely divided coal particles fed thereto from a conveyor 18. A conventional diverter chute 19 receives the coal and delivers it to one receptacle or the other. A conduit 20 leads from the upper part of the chute 19 to a filter 21 and an exhaust fan 22. A conduit 17 returns solid particles to the chute 19.

As herein shown valves 23 and 24 are provided at the opposite ends of each receptacle 16 to enable pressuring of the lock hopper. Each hopper has a tapered bottom wall 25 which directs the coal particles to an inclined feed conduit 26 that discharges into the combustion unit. The particles are fed through conduit 26 at inlet 27 where compressed air or inert gas is admitted to assist the gravity feed. A valve 28 is employed to regulate the rate of flow through each conduit 26, for example, to help control the temperature in the combustion unit or the fuel/air ratio.

Ash should be continually removed from the bed b to maintain the desired bed level, and a slide valve 29 is provided to regulate the ash removal and to close the discharge opening so that pressure is maintained in the combustion unit. An inclined chute or discharge conduit 31 receives the ash blowdown and directs it into an ash thickener tank 32 filled with water. Water is introduced from conduit 33 into conduit 31 at outlets 34 and 35 to cool the hot ash and is continually circulated by a pump 36. The water flows from the tank through conduit 37, water pump 36 and conduit 33 to the outlets 34 and 35 and then returns to the tank through conduit 31. Makeup water introduced at 38 maintains the water level above the inlet of conduit 37.

An ash quench water cooler 39 is provided to remove heat from the circulating water to maintain the desired water temperature in tank 32. The cooler receives cooling water from the supply conduit 41 and discharges the water as conduit 42.

A slurry of ash and water collects in the tank 32 above the tapered bottom wall 43 which directs the ash toward discharge conduit 44. A slurry pump 45 is provided for delivering the ash slurry through conduit 46 to land fill equipment or to a disposal site.

Other means of ash removal may be employed to realize economy of heat, particularly if tar sands are processed. For instance, a fluidized bed cooling system can be used where part of the cold combustion air required in the main combustion unit A can be preheated by fluidizing and cooling the ash and sand prior to disposal. The ash disposal method to be used can employ state of the art technology.

Combustion in the unit A must be controlled to maintain proper ash-agglomerating conditions, and the rate of air flow should be adequate to cause proper fluidization of the bed b. Relatively high gas velocities can be employed in the bed. The temperature can be regulated by control of both the air supply and the fuel supply. As shown, a header 48 is provided for the main air supply from conduit 49 to the horizontal air distribution means 50 which has a multiplicity of upwardly directed air-discharge openings located in the lower portion of the bed b below the discharge end 52 of the ash recycle conduit 53 and below the discharge end of the fuel supply conduits 26.

The compressed air from distributor 50 serves to fluidize the bed of ash particles while supporting combustion of the carbonaceous material and maintaining the desired pressure in the combustion A and the pyrolysis unit B. The pressure may be up to 10 atomspheres but is preferably from about 2 to about 5 atmospheres when cracking liquid hydrocarbon feedstocks with boiling ranges from 40° to 565° C.+ such as naphthas (typical boiling range 40° to 155° C.), gas oils (175° to 400° C.), reduced crude or vacuum residuum (boiling range to 565° C.+).

In the apparatus shown herein, the compressed air from compressor 4 passes through conduit 55 to coils 56 of the heat exchanger E and then passes through conduit 57 to the main air supply conduit 49 and to the branch conduit 58 which supplies high velocity air to the recycle conduit means 3.

The flue gases or combustion gases from the combustion unit A pass upwardly through the outlet 59 to the duct 60 and to a large number of cyclone separators 62 and 63, which remove the fine ash particles and return them to the combustion unit through return conduits 65 and 66. For example, thirty to forty cyclone separators can be provided for this purpose so that the flue gases are substantially free of ash. The gases leaving each cyclone pass through conduit 68 to the flue gas duct 70 which carries the ash-free flue gases to the steam generator and superheater D. The gases then pass through conduit 71 to the inlet of the gas turbine 5 and through the exhaust conduit 72 to the heat exchanger E. Headers 73 and 74 are shown at the conduits 71 and 72 to indicate a multiple parallel turbine arrangement and a bypass conduit 75 is provided for temporarily reducing the gas flow through the turbine (e.g., during start-up). Valves 76 and 77 are provided in conduits 71 and 75, respectively, to control the gas flow. A steam turbine 80 and an electric motor-generator 81 are connected to the turbine 5 and the compressor 4 to assist in starting and the latter for generating electricity from excess power available after starting.

The units D and E recover heat energy from the flue gases to provide steam and to preheat the liquid hydrocarbon feedstock and the air so that the flue gases are cooled preferably below 200° C. before leaving the stack 6. In the apparatus of the illustrated embodiment, boiler feed water introduced through conduit 83 to the coils 84 of the heat exchanger E are preheated, passed through the conduit 85 for additional heat pickup in downstream processing, and returned through the conduit 86 to a steam drum 90.

The cracked gases leaving duct 7 may also be used to generate steam. For example, water from the drum 90 may be fed through conduit 88 by a circulating pump 89 to a conventional heat exchanger (not shown) heated by the cracked gases to form steam which is returned to the drum through conduit 91.

As herein shown a pump 92 circulates water from drum 90 and conduit 93 through the heating coil 94 of the steam generator D and returns the water or steam to the drum, which may be under a pressure of 1000 to 1500 pounds per square inch gage or higher. Steam from the drum passes through conduit 95 to the superheater coil 96, and superheated steam is discharged through conduit 97.

As shown, steam is introduced through conduit 98 to heating coils of the heat exchanger E, a portion of the steam passing through conduit 99 and superheater coil 100 to conduit 101. Part of that superheated steam passes through conduit 102 to the bottom of the ash stripper C and serves to fluidize the bed of ash particles therein and to steam strip the ash. The remainder of the superheated steam from conduit 101 passes to branch conduit 103 and to conduit 104, which supplies the steam to the ash transfer duct 40. A slide valve 47 controls flow of the ash from unit A to duct 40, preferably in accordance with the temperature at the outlet of the pyrolysis unit B.

A portion of the steam from conduit 98 passes through branch conduit 105 to the coil 106 and mixes with the hydrocarbon feedstock.

As shown the preheated feedstock is fed through conduit 108 to the heating coil 110 of the heat exchanger E and then to the heating coil 106 where it is mixed with the dilution steam from conduit 105 and heated to a high temperature, such as 300° to 400° C. The steam and preheated hydrocarbon feedstock then passes through conduit 111 to one or more of several inlets 112, 113, 114, 115 and 116 at the wall of the pyrolysis unit B. As shown, conduit 111 extends through inlet 113 to a discharge member 117 near the central portion of the pyrolysis unit B. Injection of the feedstock and dilution steam at this point results in a short residence time in contact with the hot ash particles, which can be less than one second in unit B.

The pyrolysis unit preferably comprises an upright tubular reactor vessel or shaft reactor shaped to facilitate continuous upward flow of agglomerated ash particles and continuous discharge of the particles from the upper end of the vessel. The vessel is preferably vertical and the flow is preferably upward, but other arrangements are possible. As shown the unit B comprises a refractory-lined reactor vessel or riser 120 having a lower vertical portion 121 of reduced diameter, a main vertical cylindrical portion 122 with inlets 112–116 at one side, and a curved upper portion 123 which directs the cracked gases and ash particles horizontally to the refractory-lined roughing cyclone 2. The ash is separated out by centrifugal force and allowed to fall, and the hot cracked gas is allowed to move upwardly through curved duct 125 to a horizontal duct 126.

In order to remove most of the entrained solid particles from the cracked gas, it is preferable to provide a large number (e.g., 20 to 40) of two-stage cyclone separators 127 and 128, which may be located at opposite sides of the duct 126. Each cyclone separates out the solid particles and returns them through conduit 129 to the ash stripper unit C while allowing the cracked gas to move upwardly through conduit 131 to the main duct 7.

The separator unit 2 is a large refractory-lined cyclone separator adapted to handle large volumes of gas and to effect rapid centrifugal separation of large volumes of ash and/or sand particles, depending on the type of feedstock employed. It can handle large amounts of sand if the feedstock is a tar sand, for example. The separator can be constructed like a conventional cyclone so that the gaseous and solid material leaving the horizontal discharge portion 132 of the pyrolysis unit is caused to move around the lower vertical cylindrical end portion 133 of the duct 125. The latter end portion terminates just below the portion 132 as indicated in FIG. 1.

As herein shown, the separator unit 2 has a cylindrical upper wall portion 135, a tapered intermediate wall portion 136, a cylindrical lower wall portion 137 of reduced diameter and a tapered bottom funnel portion 138 which discharges the solid material through conduit 139 to the fluidized bed f of the stripper C. The cyclones 127 and 128 have been located outside of vessel 2, and ash stripper C was made a separate vessel in the design of FIG. 1 because of size consideration for large single train plants. For smaller plants the cyclones, roughing cyclone and ash stripper could all be contained in a single vessel.

In order to avoid unwanted secondary reactions, it is desirable to provide a water quench means for cooling the cracked gases as they leave the pyrolysis unit B. The optimum amount of cooling needed depends on the operating conditions in the riser vessel 120, such as residence time and temperature. More cooling may be desirable if the outlet temperature from the pyrolysis unit should exceed 850° C., but such temperature is preferably from about 700° to about 800° C.

As herein shown, a conduit 124 supplies cooling water to a water distribution means 130 which directs jets of water upwardly toward the inlet of the duct portion 133. The means 130 is supported in a horizontal position just below the duct 133, and the water jets are located inwardly of the wall 135 to avoid the hot ash particles which are concentrated near the periphery of that wall. The water quench at 130 preferably reduces the temperature of the cracked gases below 725° C.

As shown, the stripper unit comprises a vessel 140 with a rounded top wall 141, a cylindrical upper wall 142, a tapered intermediate wall 143, a cylindrical lower wall 144 of reduced diameter, and a tapered bottom wall 145 which communicates with a discharge conduit 146 leading from the vessel 140 to the inclined duct 53 of the recycle conduit means 3. A slide valve 148 is provided to open and close the conduit 146 in accordance with the amount of ash in the vessel 140 to regulate the height of the bed f. A control means 149, which is positioned approximately at the desired bed height, operates the valve 148 in accordance with that height.

As shown it is designed to maintain the normal bed level a short distance above the tapered wall 143.

A number of baffles 151 may be placed in the lower portion of the stripper unit C, if desired. The superheated steam introduced through conduit 102 to the bottom of the unit moves through the baffles and serves as a fluidizing gas to fluidize the ash particles of the bed and also serves as stripping steam to remove occluded hydrocarbons from the ash or other solid particles in the bed. These hydrocarbons or overheads are caused to pass upwardly through conduit 152 from the top of the unit C to the upper portion of the separator unit 2.

An outlet conduit 154 is provided at the bottom of unit C for removal of cold coked ash particles or starting sand to an ash dump truck 155 or other disposal means, and a slide valve 156 is provided to open and close the conduit.

FIG. 1 illustrates a large ethylene plant which may, for example, be designed for production of up to about one billion pounds per year.

The equipment used may be generally of the relative sizes shown, but it will be apparent that the sizes and shapes of the equipment may vary and that various other arrangements may be employed for heat or power recovery and ash removal. For instance, instead of removing ash as a slurry, a fluid bed cooler can be employed.

The equipment may be operated under varying conditions depending on the type and amounts of products sought and the type of feedstock. An example is given below showing one way in which the process can be carried out in a a large plant, such as that shown in FIG. 1, when burning bituminous coal in the combustion unit A and when cracking an atmospheric gas oil having a boiling range of from about 175° to about 375° C. Of course, this is merely for purposes of illustration and not limitation.

The plant may, for example, be started with the bypass conduit 75 open by introducing steam to the turbine 80 and introducing oil to a start-up torch (not shown) above the air distribution means 50 of the combustion unit, thereby heating a bed of screened tarter sand particles in the unit and igniting the coal particles fed to the unit from hopper 14 and/or 15. As the supply of combustion gases increases, the valve 77 is gradually closed and the valve 76 opened to obtain increased power from the gas turbine 5. The supply of steam to turbine 80 is cut off after the gas turbine is able to provide enough power to drive the compressor 4 by itself.

In a large plant of the type shown, the gas turbine 5 may, for example, be capable of delivering 20,000 to 25,000 horsepower, the motor-generator 81 may hav a rating of about 10,000 horsepower, and the start-up turbine 80 may have a rating in excess of 8,000 horsepower. Four such units in parallel operation are preferred for a plant of this size.

During operation, about 500,000 pounds of a feedstock consisting of mid-range atmospheric gas oil may be preheated to about 300° F. (150° C.) and fed to coil 110 of the heat exchanger E where its temperature increases to about 450° C. (230° C.). About 525,000 pounds per hour of dilution steam would be supplied through conduit 98 at a temperature of about 300° F. (150° C.), and about half of that steam would pass through conduit 99 and superheater coil 100 to steam conduit 104 and be superheated to a temperature of about 900° F. (480° C.), assuming that the gas temperature at the outlet of gas turbines 5 is about 950° F. (510° C.). The other half of that steam from conduit 98 (e.g., more than 250,000 pounds per hour) would be mixed with the gas oil in conduit 105 and be heated with the oil in coil 106 to a temperature of about 750° F. (400° C.).

The combustion unit A and the pyrolysis unit B could for example, be maintained at a pressure of about 45 pounds per square inch absolute with the compressors 4 delivering about 510,000 SCFM (standard cubic feet per minute) of air through conduit 55 at a temperature of about 400° F. (204° C.). The coil 56 would increase the temperature of the air to about 600° F. (315° C.). About 100,000 SCFM of this heated air would pass through conduit 58 to the ash return duct 53, and about 410,000 SCFM of the heated air would pass through the main air duct 49.

When feeding about 240,000 pounds per hour of finely divided bituminous coal to the combustion unit from conveyor 18 and operating that unit at about 2050° F. (1120° C.), it would be necessary to remove perhaps around 6,800 pounds of solids per hour at conduit 31 for disposal to maintain the desired bed level as controlled by valve 29. The volume of combustion gases delivered from combustion unit A to duct 70 would be somewhat in excess of 550,000 SCFM. The steam generator D would cool these gases from around 2000° F. (1100° C.) down to about 1250° F. (680° C.) before they reached the inlet of turbines 5, and the heat exchanger E would cool them from about 950° F. (510° C.) to about 400° F. (204° C.) before they entered the stack 6. Over 900,000 pounds per hour of superheated steam could be obtained from the steam generator D at conduit 97, for example at 1,500 psi gage and 900° F. (480° C.) while supplying over 950,000 pounds per hour of boiler feed water to conduit 83.

About 5,500,000 pounds per hour of hot agglomerated ash at a temperature of around 2050° F. (1120° C.) would pass through outlet 51 to the ash transfer duct 40 and be fed by the superheated steam to the riser reactor vessel, whose gas outlet temperature would be about 1450° F. (790° C.). The hot agglomerated ash particles would be forced upwardly through the riser vessel to provide the heat of reaction for cracking and move toward the roughing cyclone separator 2 at a substantial velocity, preferably such that the residence time for cracking is less than 0.5 second when the gas oil is admitted at injection point 113. The arrows a of FIG. 1 indicate the effective length of the riser reactor with the feedstock entering at inlet 113.

A water quench is provided by supplying about 40,000 pounds per hour of water through conduit 124, and the cracked gas enters the duct 7 at a temperature of about 1350° F. (730° C.). The water quench helps to prevent unwanted secondary reactions. The gas is then cooled in a heat exchanger (not shown) by the water from stream drum 90 and pump 89 to a temperature of about 900° F. (480° C.) before entering a conventional fractionation tower. For example, the pump 89 may circulate over 550,000 pounds of water to cool the cracked gases from duct 7.

The figures given above for purposs of illustration are, to some extent, rough estimates and can change substantially because of the many variables involved. They will, of course, vary with changes in the type or quality of the coal or the feedstock, changes in atmospheric conditions, or changes in the size of the equipment or the way it is operated. The percentage of ethylene recovered will also vary in accordance with operating conditions in the pyrolysis unit B. For example, it may be desirable to recycle 65,000 pounds per hour of ethane gas from downstream processing units through conduit 8 to the pyrolysis unit B to increase the yield of ethylene.

The cracked gases delivered from the pyrolysis unit B to the duct 7 are delivered to conventional downstream quench and fractionation equipment which may be of varying construction and which may be designed to meet specific needs. The downstream processing for recovery of ethylene and coproducts is conventional technology and is not shown. It will be understood that the water circulated by pump 89 can be used in a heat exchanger for rapidly cooling the gases from duct 7 to a temperature below 500° C. before they enter one or more fractionation towers. Various quenching systems may be employed. If desired, the cracked gases leaving the top of the pyrolysis unit B can be immediately quenched in a separate vessel with oil obtained from a downstream fractionator or quenched with vapors from a downstream gas recovery section.

A chemical plant constructed according to the present invention can provide the refiner with a great deal of flexibility and make it possible to use different feedstocks and to obtain different yields as sought by the refiner. The pressures, temperatures and other conditions can be varied, such as the amount of dilution steam utilized, the rate of feeding of the hot ash, the residence time, etc., and these changes will affect the amount of coke produced, the amount of ethylene conversion and the type of coproducts produced. This gives flexiblity in the production of the lower olefins, acetylene and other coproducts. An increase in the ethylene yield can be achieved by a reactor gas quench system design using ethane and propane from downstream processing for quenching cracking products.

The products produced can also be changed by using heavier feedstocks. The heavy feedstocks, such as reduced crude or vacuum residuum (boiling range from 400° C.+) which are considered high metals feedstocks, can be processed by the thermal cracking process of this invention. Because ash is produced in the process, the continuous purge of ash can dispose of the metals. Such a process could be substituted for a fluid catalytic cracker where olefin products are desired along with gasoline and fuel oil when processing a vacuum residuum feedstock.

Some of the heavy feedstocks having high coking tendencies can be processed in equipment of the type shown in FIG. 1 because the coke is burned off the recycled ash in burner A. If desired, a separate fluidized bed vessel may be used to burn off this coke before the ash is recycled to burner A. These and various other modifications are possible when carrying out the basic process of this invention.

The optimum operating conditions in the pyrolysis unit depend, of course, on variables, such as a type of feedstock and the degree of ethylene conversion desired. With the equipment shown in FIG. 1, there is a relatively short residence time for contact of the feedstock with the hot agglomerated ash particles in the pyrolysis unit B, which may be less than one second and can be from milliseconds to about 0.5 second. Generally the process of the invention employs an axially elongated riser-type or transfer-line-type tubular reactor with a residence time from 0.1 to 2 seconds and preferably less than 0.5 second for liquid feedstocks. The hot agglomerated ash particles are preferably moved through the reactor in an upward direction but other arrangements are possible. The temperature of about 1100° C. usually required for agglomeration of the ash in the combustion unit A is higher than that in the pyrolysis unit B, and it is desirable to employ an ash-to-hydrocarbon weight ratio of 5:1 to 20:1 to provide the required endothermic reaction heat of cracking, but preferably about 11.1 for the conditions described. The unit B should be maintained at temperatures suitable for thermal steam cracking under non-oxidizing conditions, and the amount of dilution steam should be controlled to provide suitable cracking conditions. The temperature in the unit B is preferably in the range of from 650° to 1000° C., and the outlet temperature at 132 is more preferably from 700° to 950° C. The amount of steam employed during thermal cracking depends on a number of variables. The dilution steam-to-hydrocarbon weight ratio may, for example, be from 0.1:1 to 2:1 and more preferably 1:1 when operating on gas oil at a temperature about 785° C. and a pressure of about 30 pounds per square inch gage. In any event, the amount of dilution steam should be adequate to avoid excessive coking in the pyrolysis unit.

It is also important to cool or quench the cracked gases quickly after they leave the pyrolysis unit B. For example, it is desirable to cool the cracked gases below 750° C. or below 700° C. in less than one second after the feed enters the pyrolysis unit B. The water supplied through conduit 124 to the water quench means 130 can achieve this before the cracked gases reach the duct 7 so as to slow down or stop the secondary reactions before further heat exchange or quenching in downstream equipment.

FIG. 1 shows a relatively large chemical plant, and the units A, B and C can, if desired, be proportioned substantially as illustrated. For example, the combustion unit A could have a maximum diameter of 60 to 65 feet and an overall height of 70 to 90 feet; the pyrolysis unit B could have a diameter of about 12 feet and a length of 80 to 100 feet; the roughing cyclone 2 could have a diameter of 19 to 20 feet and a height of 50 to 60 feet; and the steam stripper unit C could have a diameter of 20 feet and a height of 40 to 50 feet. Of course, these dimensions are merely exemplary, and equipment of quite different size could be used.

In carrying out the process of this invention, the coal fed to the combustion unit A could have a small particle size in the −8 to −100 Tyler mesh range. The average particle size could, for example, be about 100 microns when using a bituminous or semibituminous coal.

A major portion of the agglomerated ash particles entering duct 40 can, for example, have a particle size in the −10 to +250 Tyler mesh range and an average particle size of 300 microns. The agglomerated ash particles may include some sand or other solid material and a minor amount of the agglomerated particles may have a particle size somewhat in excess of that preferred, for example, in excess of −8 mesh. The particle size of the agglomerated ash particles is preferably such that the ash can be fed upwardly through the riser reactor B at the desired rate, which can be 10 to 100 feet per second or more. The optimum ash particle size also depends to some extent on the design of the combustion unit A and the type of material being burned. The temperature in unit A should, of course, be such as to provide for stable fluidization of the bed without excessive fusion of particles in the bed and should provide complete combustion to minimize the carbon content of the ash entering duct 40.

The pyrolysis unit B is preferably a shaft reactor or tubular reactor designed to facilitate rapid upward flow of the hot ash particles. The reactor may have an axial length 5 to 10 or more times its diameter, and in a large plant may have an axial length of 50 to 100 feet or more.

The process of this invention is well suited for use of tar sands as a feedstock, with or without substantial preliminary upgrading or pretreatment steps. It is possible to handle large volumes of sand as will be required, for example, when one ton of sand contains less than 50 gallons of oil. The tar sand can be fed to the pyrolysis unit B in the solid state using conveyors and lock hoppers similar to those shown herein for the coal feed to unit A, for example, using sand with any particle size which can be lifted by carrier steam without slippage, preferably in the average size range of 50 to 500 microns. However, the tar sand can be fed through a conduit or the like as a heated water or oil slurry. The slurry may, for example, enter the pyrolysis unit B at the same location as the gas oil feedstock.

In an apparatus of the type illustrated in FIG. 1, the sand and the ash particles would be separated from the cracked gas, steam stripped in the unit C or other suitable vessel, and then recycled to the combustion unit A to burn off the coke or char deposits. Part of the sand and ash would continually be disposed of, for example, at discharge conduit 46 or other suitable location.

It is desirable to burn the carbonaceous material on the sand particles to recover the useful energy before disposal of the sand. This burning can be carried out in the combustion unit A or in a separate burner unit.

The equipment can be modified in various ways to facilitate efficient handling of feedstocks such as tar sand or diatomaceous earth containing oil. If the tar sand is fed to the pyrolysis unit B as a water slurry, the water in the sand would provide the necessary dilution steam, and the supply of dilution steam to conduit 98 might be cut in half by shutting off conduit 105, for example.

It may also be desirable to modify or replace unit C or add a separate burner unit. For example, an additional fluid bed vessel may be added to the equipment already described for burning carbon from the excess sand for disposal. The flue gases produced from the air required for burning the carbonaceous material on the sand particles in the added unit can, for example, be passed through the conduit 3 to transfer recycle ash to unit A. The excess sand can be removed from pyrolysis unit B or unit C and fed to the added vessel for burning, cooling and disposal.

Various other modifications of the system will also occur to those skilled in the art from the disclosures above. Other ash agglomeration techniques may be employed somewhat different from those illustrated herein. Special hot zones may, for example, be provided at or near the main combustion zone to facilitate agglomeration or to facilitate ash disposal as will be apparent, for example, from the U.S. Pat. 4,097,361 of R. A. Ashworth, which discloses agglomeration of ash particles in a coal gasification unit and uses the hot ash particles to heat an upstream pyrolysis unit.

Ash agglomeration is not new, and heating with ash particles is known as indicated in the aforesaid patent application. It has been suggested in U.S. Pat. No. 3,171,369, for example, that ash particles from an ash-agglomerating combustion unit could be used to heat the fluidized bed of a coal gasification unit.

While the process of the present invention can be carried out in a simple manner, it is quite different from anything previously proposed and provides an ethylene plant with superior energy efficiency and lower operating costs while permitting manufacture of a variety of important chemical products from coal and inexpensive liquid hydrocarbon feedstocks at remarkably low cost.

It will be understood that, in accordance with the provisions of the patent laws, variations and modifications of the specific methods and devices disclosed herein may be made without departing form the spirit of the invention.

Having described my invention, I claim:

1. A thermal cracking process for manufacture of ethylene and coproducts from hydrocarbon feedstocks comprising feeding pulverulent solid particles of carbonaceous material into a combustion unit containing a fluidized bed of ash particles, passing an oxygenous gas upwardly through said bed to fluidize said ash particles, said ash particles being continually produced by combustion of said carbonaceous material, controlling the combustion of said particles and causing them to adhere to other ash particles and to agglomerate, providing a separate pyrolysis unit comprising a riser reactor vessel, introducing steam to said reactor vessel together with a feedstock containing liquid or gaseous hydrocarbons, heating said reactor vessel and the feedstock by feeding the hot agglomerated ash particles from said combustion unit through said reactor vessel to cause thermal cracking of the hydrocarbon feedstock and to form substantial amounts of olefins, removing cracked hydrocarbon gases from said pyrolysis unit, cooling said gases and separating them from the ash particles, and recycling the ash particles from said pyrolysis unit to said combustion unit.

2. A process according to claim 1 wherein dilution steam is introduced to said reactor vessel with the feedstock to reduce hydrocarbon partial pressure while maintaining an outlet temperature of 700° to 1000° C.

3. A process according to claim 1 wherein the ash particles leaving the outlet of said pyrolysis unit are immediately separated by centrifugal force from the cracked gases and said gases are immediately cooled to a temperature below 725° C.

4. A process according to claim 3 wherein the ash particles separated from the cracked gases are steam stripped to remove occluded hydrocarbons and then recycled to said combustion unit.

5. A process according to claim 4 wherein the ash particles separated from the cracked gases are collected in a separate vessel containing a bed of said ash particles, and steam is passed upwardly through said bed to fluidize the particles.

6. A process according to claim 3, claim 4 or claim 5 wherein the cracked gases and ash particles from said pyrolysis unit are passed to a cyclone separator and water is introduced into the hot gases as they move through said separator to cool the gases below 725° C. immediately after they have been separated from the ash particles.

7. A process according to claim 1, claim 2, claim 3 or claim 5 wherein said agglomerated ash particles are heated to a temperature of from about 1000° to about 1150° C. and then fed through said pyrolysis unit by superheated steam.

8. A process according to claim 7 wherein said combustion unit and said pyrolysis unit are maintained under pressure, compressed air is continually fed to said combustion unit to fluidize the bed and to maintain said pressure, and the flue gases from said combustion unit are cooled to recover heat and passed through a turbine to recover power for compressing said air.

9. A process according to claim 1 wherein said combustion unit burns finely divided coal and is maintained at a temperature of from about 1000° to about 1150° C. to cause agglomeration of the ash particles and wherein said pyrolysis unit is maintained at a temperature of from 700° to 950° C. and at a pressure of from 2 to 8 atmospheres.

10. A process according to claim 9 wherein said pyrolysis unit comprises a vertical shaft vessel and superheated steam is fed upwardly through said vessel to cause continuous rapid movement of the hot ash particles through said vessel.

11. A process according to claim 1, claim 3, claim 5 or claim 9 wherein at least a portion of said feedstock consists of gaseous hydrocarbons.

12. A process according to claim 1, claim 2, claim 3, claim 5 or claim 9 wherein said feedstock comprises petroleum distillates with boiling ranges from about 40° C. to about 565° C.

13. A process according to claim 12 wherein said feedstock is a gas oil.

14. A process according to claim 12 wherein said feedstock has a boiling range from about 175° C. to about 565° C.

15. A process according to claim 12 wherein said feedstock has a boiling range from about 400° to about 565° C.

16. A process according to claim 12 wherein the temperature at the outlet of said pyrolysis unit is from about 700° to about 950° C., and wherein said unit is maintained at a pressure of from about 3 to about 8 atmospheres.

17. A process according to claim 1, claim 3, claim 5 or claim 9 wherein said feedstock comprises a tar sand.

18. A process according to claim 1 or claim 9 wherein the sand and ash particles are separated from the cracked gases by centrifugal force and passed to a separate vessel containing a fluidized bed of sand and ash particles, a portion of the solid material is removed from the bed after burning the coke, and the remaining ash is recycled to said combustion unit.

19. In a thermal cracking process for manufacture of lower olefins and valuable coproducts from a liquid or gaseous hydrocarbon feedstock wherein said feedstock and steam are fed to a pyrolysis unit comprising a reactor vessel maintained under non-oxidizing conditions at a temperature of from about 700° C. to about 1000° C. and the hydrocarbons are cracked to produce ethylene and coproducts, the improvement which comprises feeding pulverulent coal particles into a combustion unit containing a fluidized bed of ash particles, passing compressed air from a compressor upwardly through said bed to fluidize said ash particles and to maintain the combustion unit under pressure, said ash particles being continually produced by combustion of said coal particles, causing the hot ash particles to stick together and to agglomerate, heating said pyrolysis unit by feeding the hot agglomerated ash particles from said combustion unit upwardly through said reactor vessel, maintaining the reactor vessel and the combustion unit at a pressure of at least 2 atmospheres, separating the cracked hydrocarbon gases from the ash particles leaving the upper portion of said reactor vessel, recycling the ash particles to said combustion unit, and passing combustion gases from said combustion unit through a turbine to provide power for driving said compressor.

20. A process according to claim 19 wherein a separate vessel is provided having a fluidized bed of ash particles, and wherein the ash particles from said pyrolysis unit which are separated from the cracked gases are collected in said last-named bed before being recycled to said combustion unit.

21. A process according to claim 20 wherein steam is fed to the lower portion of said last-named bed to fluidize the bed and remove occluded hydrocarbons from the ash particles.

* * * * *

UNITED STATES PATENT AND TRADEMARK OFFICE

CERTIFICATE OF CORRECTION

PATENT NO. : 4,172,857

DATED : October 30, 1979

INVENTOR(S) : Stanley J. PAVILON

It is certified that error appears in the above-identified patent and that said Letters Patent are hereby corrected as shown below:

Complete the Abstract of the Disclosure by adding the following: --Operating the combustion unit and the riser reactor at a pressure, such as 2 to 8 atmospheres, makes it possible to pass the combustion gases through a heat exchanger and a gas turbine to recover heat and power for air compression and to achieve very high efficiency while obtaining excellent yields of ethylene and other valuable coproducts from inexpensive feedstocks.--

Column 3, line 60, change "production" to --a--.

Column 6, line 33 should read: --combustion unit A--;

" ", line 34, change "atomspheres" to --atmospheres-

UNITED STATES PATENT AND TRADEMARK OFFICE

CERTIFICATE OF CORRECTION

PATENT NO. : 4,172,857

DATED : October 30, 1979

INVENTOR(S) : Stanley J. Pavilon

It is certified that error appears in the above-identified patent and that said Letters Patent are hereby corrected as shown below:

Column 9, line 61 "450°C." should read --450°F.--

Column 11, line 35, should read --quenching cracked products--.

Column 13, line 5 should read --an axial height of--.

Signed and Sealed this

*Twenty-sixth* Day of *February 1980*

[SEAL]

*Attest:*

SIDNEY A. DIAMOND

*Attesting Officer*

*Commissioner of Patents and Trademarks*